US011473173B2

(12) United States Patent
Nishiyama et al.

(10) Patent No.: US 11,473,173 B2
(45) Date of Patent: Oct. 18, 2022

(54) α+βTITANIUM ALLOY EXTRUDED SHAPE

(71) Applicant: NIPPON STEEL CORPORATION, Tokyo (JP)

(72) Inventors: Shinya Nishiyama, Tokyo (JP); Yoshihisa Shirai, Tokyo (JP); Akira Kawakami, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 50 days.

(21) Appl. No.: 16/343,111

(22) PCT Filed: Dec. 22, 2016

(86) PCT No.: PCT/JP2016/088344
§ 371 (c)(1),
(2) Date: Apr. 18, 2019

(87) PCT Pub. No.: WO2018/116444
PCT Pub. Date: Jun. 28, 2018

(65) Prior Publication Data
US 2019/0300987 A1 Oct. 3, 2019

(51) Int. Cl.
*C22C 14/00* (2006.01)
*C22F 1/18* (2006.01)

(52) U.S. Cl.
CPC ..... *C22C 14/00* (2013.01); *C22F 1/183* (2013.01)

(58) Field of Classification Search
CPC ..... C22C 14/00; C22F 1/183
See application file for complete search history.

(56) References Cited

U.S. PATENT DOCUMENTS

2013/0037183 A1 2/2013 Daffos et al.

FOREIGN PATENT DOCUMENTS

| | | | |
|---|---|---|---|
| JP | 61-193719 | A | 8/1986 |
| JP | 61-284560 | A | 12/1986 |
| JP | 63-223155 | A | 9/1988 |
| JP | 5-2405 | B2 | 1/1993 |
| JP | 6-184683 | A | 7/1994 |
| JP | 2932918 | B2 | 8/1999 |
| JP | 2010-37639 | A | 2/2010 |
| JP | 2012-52219 | A | 3/2012 |
| JP | 2013-508550 | A | 3/2013 |
| JP | 2016-199796 | A | 12/2016 |

OTHER PUBLICATIONS

Zherebtsov et al., Effect of hydrostatic extrusion at 600-700° C. on the structure and properties of Ti-6AI-4V alloy, Jun. 25, 2008, Elsevier, Materials Science and Engineering A, vol. 485, pp. 39-45 (Year: 2008).*

(Continued)

*Primary Examiner* — Anthony M Liang
(74) *Attorney, Agent, or Firm* — Birch, Stewart, Kolasch & Birch, LLP

(57) ABSTRACT

An α+β titanium alloy extruded shape containing, in mass %, Al: 5.5 to 6.8%, V: 3.5 to 5.8%, and Fe: over 0 to 0.30%, the balance being Ti and impurities, the impurities amounting to a total of 0.4% or less, the alloy including an acicular microstructure in which an average prior β grain size is 250 μm or less.

4 Claims, 4 Drawing Sheets

1 CONTAINER
2 STEM
3 DUMMY BLOCK
4 DIE
5 BILLET
6 EXTRUDED SHAPE
11 EXTRUSION DIRECITON

(56) References Cited

OTHER PUBLICATIONS

Roy et al., Microstructure and texture evolution during β extrusion of boron modified Ti-6AI-4V alloy, Apr. 1, 2012, Materials Science and Engineering A, 540, pp. 152-163 (Year: 2012).*
Semiatin et al., Microstructure evolution during alpha-beta heat treatment of Ti-6AI-4V, Oct. 2003, Metallurgical and Materials Transactions A, vol. 34A, pp. 2377-2386 (Year: 2003).*
Seshacharyulu et al., Microstructural mechanisms during hot working of commercial grade Ti-6AI-4V with lamellar starting structure, Feb. 28, 2002,Materials Science and Engineering A, vol. 325, pp. 112-125 (Year: 2002).*
Katzarov et al., Finite element modeling of the morphology of β to α phase transformation in Ti-6AI-4V alloy, Apr. 2002, Metallurgical and Materials Transactions A, vol. 33, pp. 1027-1040 (Year: 2002).*
International Search Report for PCT/JP2016/088344 dated Feb. 14, 2017.
Written Opinion of the International Searching Authority for PCT/JP2016/088344 (PCT/ISA/237) dated Feb. 14, 2017.
Extended European Search Report, dated Feb. 13, 2020, for European Application No. 16924753.3.
Gungor et al., "Microstructure and mechanical properties of highly deformed Ti-6A1-4V", Materials Science and Engineering A, 2005, vol. 410-411, pp. 369-374 ( 6 pages).
Roy et al., "Microstructure and texture evolution during β extrusion of boron modified Ti-6A1-4V alloy", Materials Science and Engineering A, 2012, vol. 540, pp. 152-163 (12 pages).
Zherebtsov et al., "Effect of hydrostatic extrusion at 600-700° C. on the structure and properties of Ti-6A1-4V alloy", Materials Science and Engineering A, 2008, vol. 485, pp. 39-45 ( 8 pages).
Takayama et al., "Titanium Alloy Bar Suitable for Highly Efficient Wear-Resistance Treatment," International Congress and Exposition, Detroit, Michigan, Feb. 27-Mar. 2, 1995, pp. 269-275, 9 pages total.

* cited by examiner

1 CONTAINER
2 STEM
3 DUMMY BLOCK
4 DIE
5 BILLET
6 EXTRUDED SHAPE
11 EXTRUSION DIRECITON

α+βTITANIUM ALLOY EXTRUDED SHAPE

TECHNICAL FIELD

The present invention relates to an α+β titanium alloy extruded shape having a uniform acicular microstructure and excellent in tensile property and shape.

BACKGROUND ART

Owing to high specific strength and excellent corrosion resistance, titanium alloys have found their application in a variety of fields such as aggregate and structural members of airplanes, consumer products such as golf face club heads and eyeglass frames, and medical products such as implants.

Among these, the aerospace industry is a main field where the α+β titanium alloys are heavily used because of their high strength-ductility balance and excellent fracture toughness. In the application requiring especially high strength, an α+β titanium alloy containing Al and V has been used for many years, Al being an inexpensive element which becomes a substitutional solid-solution in an α phase to cause solid solution strengthening at room temperature and high temperatures, and V being a β stabilizing element and not likely to undergo solidification segregation. The α+β titanium alloys whose main contained elements are Al and V are titanium alloys currently occupying an about eighty percent of practically used titanium alloys and used in the largest amount.

Such α+β titanium alloys, typically Ti-6Al-4V used in the largest amount, have been used mainly in the aircraft field for many years. With a recent increase in an application ratio of carbon fiber reinforced plastics (CFRP) to airframes with the aim to further reduce fuel consumption, a use ratio of titanium alloys is also increasing and is expected to further increase in the future. Aluminum alloys conventionally used in the aircraft field have problems that they undergo galvanic corrosion when in contact with CFRP, are greatly different in thermal expansivity from CFRP to easily cause displacement, slack, and the like due to a temperature difference (about 100° C.) between the flight atmosphere and the ground, whereas titanium alloys do not undergo galvanic corrosion even when in contact with CFRP and are closer in thermal expansivity to CFRP than aluminum alloys.

In particular, an α+β titanium alloy whose main contained elements are Al and V is sometimes used as aggregate or an extruded shape of such as a seat rail in the aircraft application. Some extruded shape has a complicated sectional shape and such a shape has been conventionally manufactured by a cutting work of a forged product having a large section or a material having a very large thickness. An α+β titanium alloy, in a case where it is subjected to the cutting work after forged, is hard-worked at a β transus temperature or lower so as to have an equiaxed microstructure having high strength-ductility balance, thereby achieving a required tensile property, in particular, high proof stress.

However, recent circumstances where a need for a manufacturing cost reduction of components for aircraft is increasing have given rise to hopes for improving yields and productivity by manufacturing a long extruded shape having a sectional shape similar to that of a final product is expected, and a technique for manufacturing the extruded shape by a hot extrusion work has been developed.

The extrusion works include an indirect extrusion process, a hydrostatic extrusion process and so on.
The Ugine-Sejournet process is one of them. A material in this process is a round billet manufactured through the forging of an ingot. As illustrated in FIG. 1, a material (billet 5) is inserted into a container 1, and a hydraulic load is applied to a stem 2, so that the billet 5 is pushed via a dummy block 3 in an extrusion direction 11 and passes through a die 4 to be formed into any of various sectional shapes, whereby a long extruded shape 6 can be obtained.

Incidentally, in the metal microstructure of the α+β titanium alloy to be used in the application requiring high strength-ductility balance, the required high tensile strength is achieved by controlling the metal microstructure to the equiaxed microstructure by the hard working such as the forging at the β transus temperature or lower (in an α+β temperature range), as described above. On the other hand, in a case where the metal microstructure is controlled to the equiaxed microstructure in extrusion manufacturing process, in a temperature range lower than the β transus temperature ($T_\beta$) by 200° C. or more, the hot deformation resistance of the α+β titanium alloy rapidly becomes high as decreasing temperature, and accordingly a large extrusion press capable of applying a high extrusion load is necessary, which not only increases a facility cost but also may fail the extrusion. Further, even when the extrusion is possible, if a temperature of part in a cross section of the extruded shape exceeds the β transus temperature due to working heat generation during the extrusion, the equiaxed microstructure and the acicular microstructure which is obtained by the work at the β transus temperature or higher are both present in the cross section of the extruded shape, causing a great mechanical property variation in the cross section. Therefore, in the extrusion of the α+β titanium alloy, the billet is usually heated to the β transus temperature or higher and extruded so as to enable the manufacture with a low extrusion load and so as not to easily cause a surface defect, whereby the microstructure of the extruded shape after the extrusion is controlled to the acicular microstructure.

However, extruding the billet heated to the β transus temperature or higher has a problem that the extruded shape after the extrusion has the acicular microstructure and its strength-ductility balance is inferior to that of the equiaxed microstructure. Further, in the case where the heating temperature of the billet is higher than the β transus temperature, the billet is kept at the β transus temperature or higher for a long time after the extrusion and accordingly β grains grow, leading to a further decrease in the strength-ductility balance.

On the other hand, if the heating temperature of the billet is close to the β transus temperature or is lower than the β transus temperature, a temperature of its surface layer decreases to the β transus temperature or lower due to heat removal when it comes into contact with extrusion tools such as the container and the die, so that the equiaxed microstructure slips into the surface layer. Further, the surface layer deteriorates in ductility due to the temperature decrease, which may cause defects such as a crack and a flaw during the extrusion.

As described above, in obtaining the extruded shape having the acicular microstructure by the extrusion work, it is difficult to control the extrusion temperature, and there are problems that too high an extrusion temperature deteriorates the tensile property, while too low an extrusion temperature causes the surface defects and makes the extrusion impossible due to a high extrusion load. In order to solve these problems, the following prior arts are disclosed.

Patent Document 1 describes a method of manufacturing an extruded shape having high strength and high toughness, undergoing only a small dimension change in a longitudinal direction and thus having less surface flaw, by heating a Ti-6Al-4V alloy, which is an α+β titanium alloy, to an α+β temperature range and subjecting it to an extrusion work.

Patent Document 2 describes a method of manufacturing an extruded shape excellent both in strength and ductility by heating an α+β titanium alloy to an α+β temperature range or a β single-phase temperature range and subjecting it to an extrusion work, thereafter subjecting it to two-stage heat treatment composed of: solution heat treatment of heating it to the α+β temperature range, followed by forced cooling; and subsequent aging treatment.

Patent Document 3 describes a method of manufacturing an extruded shape having strength and ductility comparable to those of an extruded shape obtained by an extrusion work in an α+β range, by subjecting an α+β titanium alloy billet having a fine equiaxed α+β microstructure to an extrusion work at a β transus temperature or higher, quenching it at 5° C./second or more, and thereafter annealing it.

Patent Document 4 proposes a method in which an α+β titanium alloy billet is heated to a β transus temperature or higher, thereafter its surface layer is cooled to an α+β range, and then the billet is subjected to an extrusion work. In this method, since the inside of the billet has been heated to the β transus temperature or higher at the time of the extrusion, hot deformation resistance is small, enabling the extrusion work with small extrusion force, and the obtained extruded shape has the surface layer with an equiaxed α+β microstructure and thus is high in strength.

Patent Document 5 discloses a manufacturing method in which an α+β titanium alloy billet is heated to an α+β temperature range calculated by a linear expression including an extrusion ratio and is subjected to an extrusion work, thereby eliminating a need for subsequent heat treatment owing to working heat generation during the extrusion.

Patent Document 6 describes a method of manufacturing an extruded shape excellent in fatigue strength, by performing a microstructure control by subjecting an α+β titanium alloy billet to an extrusion work at a temperature of an α+β range calculated by a linear is expression including an extrusion ratio.

DISCLOSURE OF THE INVENTION

Prior Art Document

[Patent Document]

[Patent Document 1] Japanese Laid-open Patent Publication No. S61-193719

[Patent Document 2] Japanese Laid-open Patent Publication No. S61-284560

[Patent Document 3] Japanese Laid-open Patent Publication No. S63-223155

[Patent Document 4] Japanese Examined Patent Publication No. H5-2405

[Patent Document 5] Japanese Patent No. 2932918

[Patent Document 6] Japanese Laid-open Patent Publication No. 2012-52219

DISCLOSURE OF THE INVENTION

Problems to be Solved by the Invention

The α+β titanium alloy extruded shapes according to the above-described prior arts all achieve an improvement in the strength-ductility balance by the microstructure control by the forced cooling performed after the extrusion, or by the microstructure control to the microstructure other than the acicular microstructure.

The extruded shape having undergone the microstructure control by the forced cooling has high strength-ductility balance. This is because, as a cooling rate increases, a side plate α phase and a grain boundary α phase in the acicular microstructure are inhibited from growing during the cooling. However, in a case of a long material and an extruded shape having a large sectional area, the cooling rate varies along the whole length or the inside and outside of the extruded shape at the time of the forced cooling, leading to a problem that the intended microstructure and material properties cannot be obtained in some region. Further, in the cooling process, stress is generated inside the extruded shape due to thermal contraction. Accordingly, if the difference in the cooling rate is great and the stress is large, a defective shape such as a warp may occur due to plastic deformation or residual stress may remain even after the cooling, which is not preferable.

In the method which controls the microstructure of the extruded shape to the microstructure other than the acicular microstructure, it is necessary to control a partial or entire region of the billet to the α+β temperature range. However, when the working temperature decreases to the β transus temperature or lower, the α+β titanium alloy has high hot deformation resistance, necessitating large pressing force. Further, in the α+β temperature range, a working heat generation amount is large, and accordingly the working temperature may exceed the β transus temperature due to the working heat generation during the extrusion. As a result, an extruded shape having a uniform microstructure is not obtained, leading to a problem of non-uniform mechanical properties. Further, the method which provides the temperature gradient in the billet cross section has a problem that a stable shape cannot be obtained because a degree of the deformation varies due to a slight temperature difference in the cross section.

Under such circumstances, it is an object of the present invention to provide a Ti-6Al-4V extruded shape having an acicular microstructure yet having a small warp and having strength-ductility balance comparable to those of the prior arts.

Means for Solving the Problems

Specifically, the gist of the present invention is as follows.

(1)

An α+β titanium alloy extruded shape containing, in mass %, Al: 5.5 to 6.8%, V: 3.5 to 4.5%, and Fe: 0 to 0.30%, the balance being Ti and impurities, the impurities amounting to a total of 0.4% or less, the alloy including an acicular microstructure in which an average prior β grain size is 250 μm or less.

(2)

The α+β titanium alloy extruded shape according to (1), wherein the average prior β grain size is 180 μm or less.

(3)

The α+β titanium alloy extruded shape according to (1), wherein, in a colony of the acicular microstructure, an average ratio of a concentration of V contained in a side plate α phase to a concentration of V contained in a side plate β phase is 0.24 or less, and an average concentration of Fe contained in the side plate β phase is 1.1% or more.

(4)

The α+β titanium alloy extruded shape according to (1), wherein a width of a grain boundary α phase is 5 μm or less.

Effect of the Invention

According to the present invention, an α+β titanium alloy extruded shape whose main contained elements are Al and V can be an extruded shape whose 0.2% proof stress is 830 MPa or more and whose elongation is 10% or more, by having an acicular microstructure in which the average prior β grain size is 250 μm or less. Further, it is possible for the extruded shape to have 0.2% proof stress of much higher than 830 MPa, by setting the average ratio of the concentration of V contained in the side plate α phase to the concentration of V contained in the side plate β to 0.24 or less and setting the average concentration of Fe contained in the side plate β phase to 1.13% or more, in the colony of the acicular microstructure.

EMBODIMENTS FOR CARRYING OUT THE INVENTION

An α+β titanium alloy whose main contained elements are Al and V, which is a target of the present invention, is composed of an α phase having an HCP structure and a β phase having a BCC structure at a β transus temperature or lower, while, at the β transus temperature or higher, composed only of the β phase, with the α phase transformed into the β phase. This alloy can have an acicular microstructure when heated to the β transus temperature or higher and then cooled, and when it is worked at the β transus temperature or lower, α grains with a large aspect ratio in the acicular microstructure are split, and the acicular microstructure changes to an equiaxed microstructure illustrated in FIG. 2(2) as a working amount increases.

Figure 1:
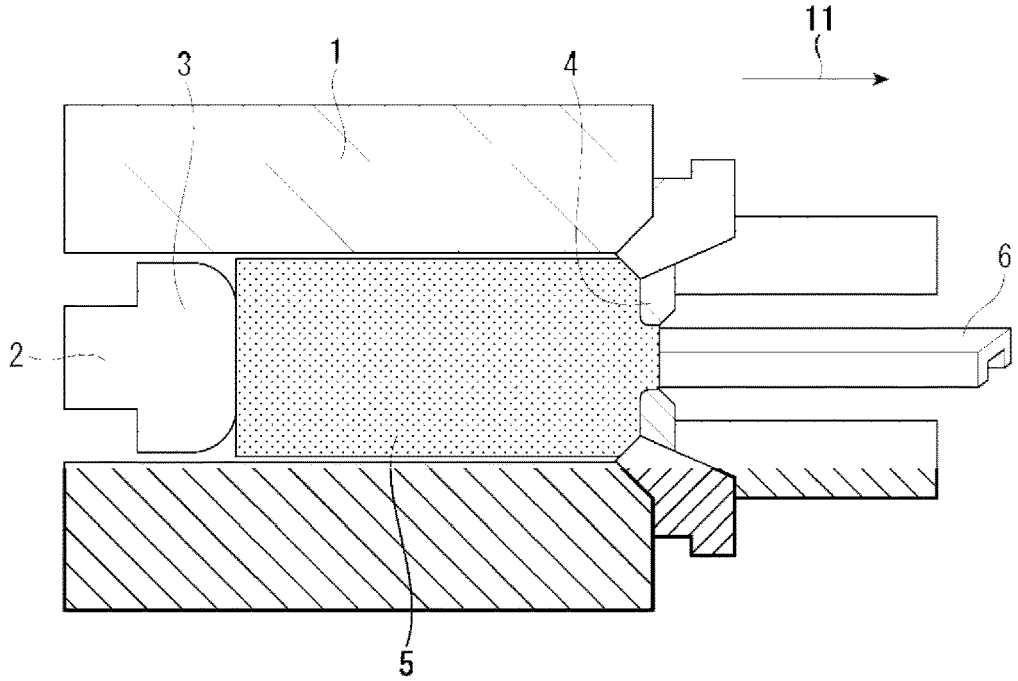
FIG. 1 is a schematic view of an extrusion press machine in a Ugine-Sejournet process.
Figure 2:
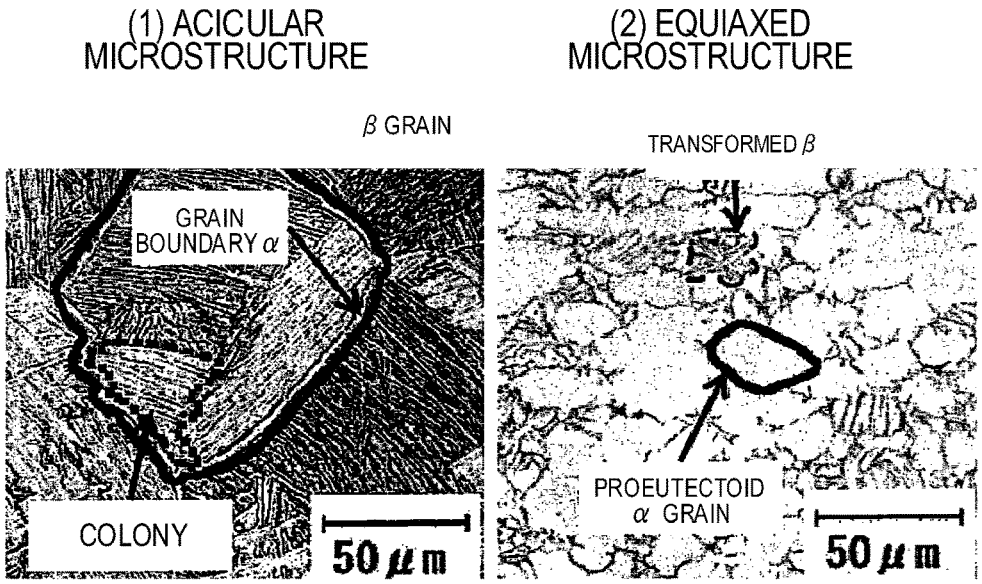
FIG. 2 (1) is a micrograph showing an acicular microstructure of an α+β titanium alloy extruded shape, and (2) is a micrograph showing an equiaxed microstructure of the α+β titanium alloy.

FIG. 2(1) illustrates the form of the acicular microstructure which is the microstructure form obtained at the time of the cooling following the heating to the β transus temperature or higher. A grain boundary α phase is generated along a boundary of a prior β grain which was one grain at the β transus temperature or higher. That is, along the grain boundary of the β grain present at the β transus temperature or higher (prior β grain), the grain boundary α phase is formed during the cooling. A region surrounded by the grain boundary α phase which is the grain boundary of the β grain present at the β transus temperature or higher (prior β grain) is called a "prior β grain" in the present invention. In the prior β grain, a plurality of microstructures called colonies in each of which the α phase and the β phase are arranged in layers are formed. Hereinafter, in the colony, the α phase will be referred to as a side plate α phase, and the β phase will be referred to as a side plate β phase.

Typically, during cooling, metal thermally contracts to reduce in volume. In a case where a cooling rate differs depending on each region, at a given time during the cooling, stress is generated inside the extruded shape due to a difference in heat contraction amount. In a case where the cooling rate of the extruded shape is low as in air cooling, furnace cooling, and the like, such stress only gives elastic deformation to the extruded shape. However, the conventional arts achieve the high strength-ductility balance by controlling the microstructure or the composition by the forced cooling immediately after the extrusion or by the solution heat treatment (from a high-temperature range to the forced cooling) in the heat treatment after the extrusion. In the forced cooling in these, great stress is generated due to a large difference in the cooling rate, giving plastic deformation such as a warp to the extruded shape. Further, even if the defective shape does not occur during the cooling, residual stress is generated in the extruded shape, causing a defective shape such as a warp during the machining, cutting, and so on of the extruded shape.

Under such circumstances, the present inventors performed hot extrusion of an α+β titanium alloy under varied heating conditions and studied a relation between a tensile property and an acicular microstructure of an extruded shape, and as a result, have found out that, by having the acicular microstructure in which an average prior β grain size is 250 μm or less, an extruded shape can have 0.2% proof stress of 830 MPa or more and elongation of 10% or more, and can have strength-ductility balance comparable to those of the conventional arts, without using forced cooling. It has been further found out that it is possible for an α+β titanium alloy extruded shape to have 0.2% proof stress of much higher than 830 MPa, by setting an average ratio of the concentration of V contained in the side plate α phase to the concentration of V contained in the side plate β phase to 0.24 or less and setting an average concentration of Fe contained in the side plate β phase to 1.1% or more, in the colony of the acicular microstructure.

The significance of deciding the component composition in the present invention will be described.

A target of the present invention is a titanium alloy whose main contained elements are Al and V, that is, Ti-6Al-4V. JIS H4650, ASTM B348, and the like stipulate components (mass %) of Ti-6Al-4V as follows: Al: 5.50 to 6.75%, V: 3.50 to 4.50%, Fe: 0.30% or less, C: 0.08% or less, N: 0.05% or less, O: 0.20% or less, H: 0.015% or less, and other elements: 0.10% or less, the other elements amounting to a total of 0.40% or less. The titanium alloy of the present invention whose main contained elements are Al and V also has components within the ranges stipulated in these official standards. Hereinafter, reasons for limiting the components will be described.

Al: 5.5 to 6.8 Mass %

Al is an α stabilizing element and is an element which is added for the purpose of increasing a fraction of the α phase. If its content is less than 5.5 mass %, the fraction of the α phase higher in strength than the β phase becomes excessively small, which does not enable to obtain sufficient strength and excellent 0.2% proof stress. On the other hand, if its content is excessively large over 6.8 mass %, ductility deteriorates and at the same time, $Ti_3Al$ precipitates to deteriorate toughness, leading to poor workability. Therefore, a lower limit of the content of Al is set to 5.5 mass % and its upper limit is set to 6.8 mass %.

V: 3.5 to 4.5 Mass %

V is a β stabilizing element and is an element which is added for the purpose of increasing a fraction of the β phase.

That is, V acts to lower a β transus temperature, and allows to decrease a working temperature of the titanium alloy. Further, V acts to increase strength, and if its content is less than 3.5 mass %, the faction of the β phase becomes excessively small and at the same time, 0.2% proof stress deteriorates. On the other hand, if its content is excessively large over 4.5 mass %, elongation deteriorates, leading to poor workability. Therefore, a lower limit of the content of V is set to 3.5 mass %, and its upper limit is set to 4.5 mass %.

Fe: Over 0 to 0.30 Mass %

Fe is a 0 stabilizing element and acts to lower the β transus temperature when it is added. Further, since it acts to improve 0.2% proof stress, over 0 mass % Fe is preferably added. However, increasing the content of Fe results in deterioration in ductility, leading to poor workability. Therefore, its upper limit is set to 0.30 mass %.

H: 0.015 Mass % or Less

If the content of H is excessively large over 0.015 mass %, not only elongation deteriorates but also a fragile hydride is formed, rendering the titanium alloy brittle. Therefore, an upper limit of the content of H is set to 0.015 mass %.

O: 0.20 Mass % or Less, C: 0.08 Mass % or Less, N: 0.05 Mass % or Less, Fe: 0.30 Mass % or Less O, C, and N are a stabilizing elements, and when added, they act to increase the fraction of the α phase and improve 0.2% proof stress. However, if the contents of these elements increase, ductility deteriorates, leading to poor workability. Therefore, their contents are set as follows: O: 0.20 mass % or less, C: 0.08 mass % or less, and N: 0.05 mass % or less.

The Balance: Ti and Impurities, the Impurities Amounting to a Total of 0.40 Mass % or Less The balance is composed of Ti and the impurities. Examples of elements as the impurities include impurities such as Cl, Na, and Mg which are mixed in a refining process of titanium, and Zr, Sn, Cu, Mo, Ni, Nb, Ta, Mn, and Cr which are mixed from scraps. Any of the impurities, when its content increases, generates a compound with Ti to lower toughness, resulting in poor workability. Further, if the total content of the impurities is excessively large, ductility deteriorates, leading to poor workability. Therefore, the total amount of the other elements needs to be controlled to 0.40 mass % or less in order to prevent them from inhibiting the effect of the present invention.

Next, the significance of limiting the prior β grain size in the present invention will be described.

Figure 3:
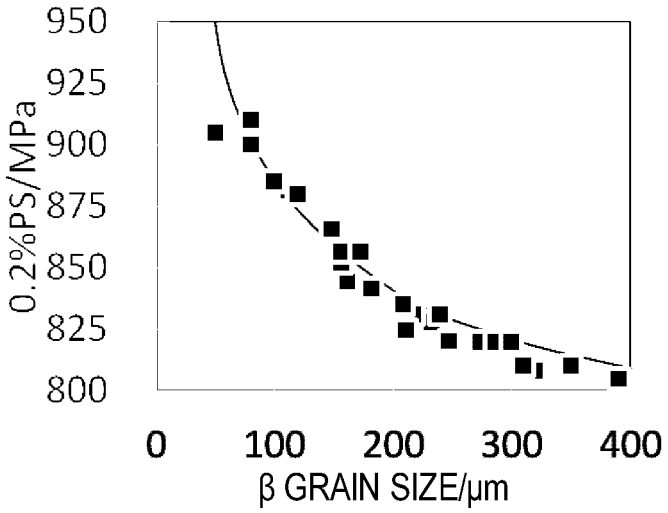
FIG. 3 is a chart illustrating a relation between a prior β grain size of a metal microstructure and 0.2% proof stress.

In the acicular microstructure, since partial dislocation easily transfer across an α/β phase boundary, a piled-up length of the partial dislocation is given as a half of colony size. Further, the colony size decreases with a decrease in the prior β grain size. Therefore, with the decrease in the prior β grain size, a stress field due to the pileup of the dislocation at a colony boundary decreases, and 0.2% proof stress tends to increase due to the fine grain strengthening microstructure (FIG. 3). Conversely, an increase in the prior β grain size increases the piled-up length of the dislocation to increase stress concentration occurring at the colony boundary, resulting in a decrease in 0.2% proof stress. Further, the decrease in the prior β grain size decreases the colony size to reduce the number of the dislocations piled up at the prior β grain boundary and the colony boundary, and accordingly the stress concentration at the prior β grain boundary and the colony boundary is alleviated and elongation increases. Therefore, in the present invention, 250 μm which is an average prior β grain size giving 0.2% proof stress of 830 MPa or more and elongation of 10% is set as an upper limit. On the other hand, a lower limit is not necessarily limited, but is preferably 50 μm or more. To achieve the finer size, it is necessary to lower the extrusion temperature or perform hard working at the time of the extrusion, which increases deformation resistance to increase a load to the device, and therefore, the aforesaid lower limit is preferable.

Further, the significance of limiting the ratio of the concentration of V contained in the side plate α phase to the concentration of V contained in the side plate β phase in the colony (interphase V concentration ratio) and the concentration of Fe contained in the side plate β phase in the colony will be described.

Since the β phase is lower in strength than the α phase, the β phase is responsible for the deformation in an early stage of the work. Accordingly, the strength up to yield in the early stage of the work is governed by the strength of the β phase. That is, 0.2% proof stress is governed by the strength of the β phase. At this time, if a strength difference between the β phase and the α phase is large, the dislocation introduced to the β phase during the work further concentrates, leading to deterioration in 0.2% proof stress. Since V and Fe improve the strength of the β phase by being solid-dissolved in the β phase (solid-solution strengthening), an increase of V and Fe in the β phase alleviates the strength difference between the β phase and the α phase to increase 0.2% proof stress. Therefore, the interphase V concentration ratio of 0.24 and the Fe concentration of 1.1% which give 0.2% proof stress of over 830 MPa considered as high strength are set as a preferable lower limit of the interphase V concentration and a preferable upper limit of the Fe concentration.

In the acicular microstructure, with an increase in the width of the grain boundary α phase, ductility deteriorates. The grain boundary α phase is generated on the prior β grain boundary where the dislocation is likely to pile up during the work. Accordingly, voids are likely to be generated on a grain boundary α phase interface during the work, but the increase in the width of the grain boundary α phase facilitates the progress of the voids along the grain boundary α. Therefore, in the present invention, 5 μm which is the maximum grain boundary α width obtained in standing-to-cool and which gives elongation of not lower than 10% is set as an upper limit of the width of the grain boundary α phase. On the other hand, its lower limit is preferably 0.5 μm or more, though not necessarily limited. In order to make it further smaller, forced cooling such as water cooling or fan air cooling is necessary, which increases a temperature difference in the extruded shape, causing a defective shape due to internal stress, or residual stress after the air cooling. Therefore, the aforesaid lower limit is preferable.

Next, a method of manufacturing the α+β titanium alloy extruded shape of the present invention will be described.

In the present invention, after heating to a β single-phase temperature range, air cooling is performed in order to avoid the deformation ascribable to thermal stress and avoid the generation of residual stress, and accordingly the width of the side plate α phase and the grain boundary α phase grow during the cooling, resulting in lower 0.2% proof stress and ductility than in the conventional inventions. Therefore, in the present invention, studies were made on a means for inhibiting the growth of the β grains by limiting the heating temperature and the holding time in the case where the heating to the β transus temperature or higher is performed, and an attempt was made to increase 0.2% proof stress and ductility.

Figure 4:
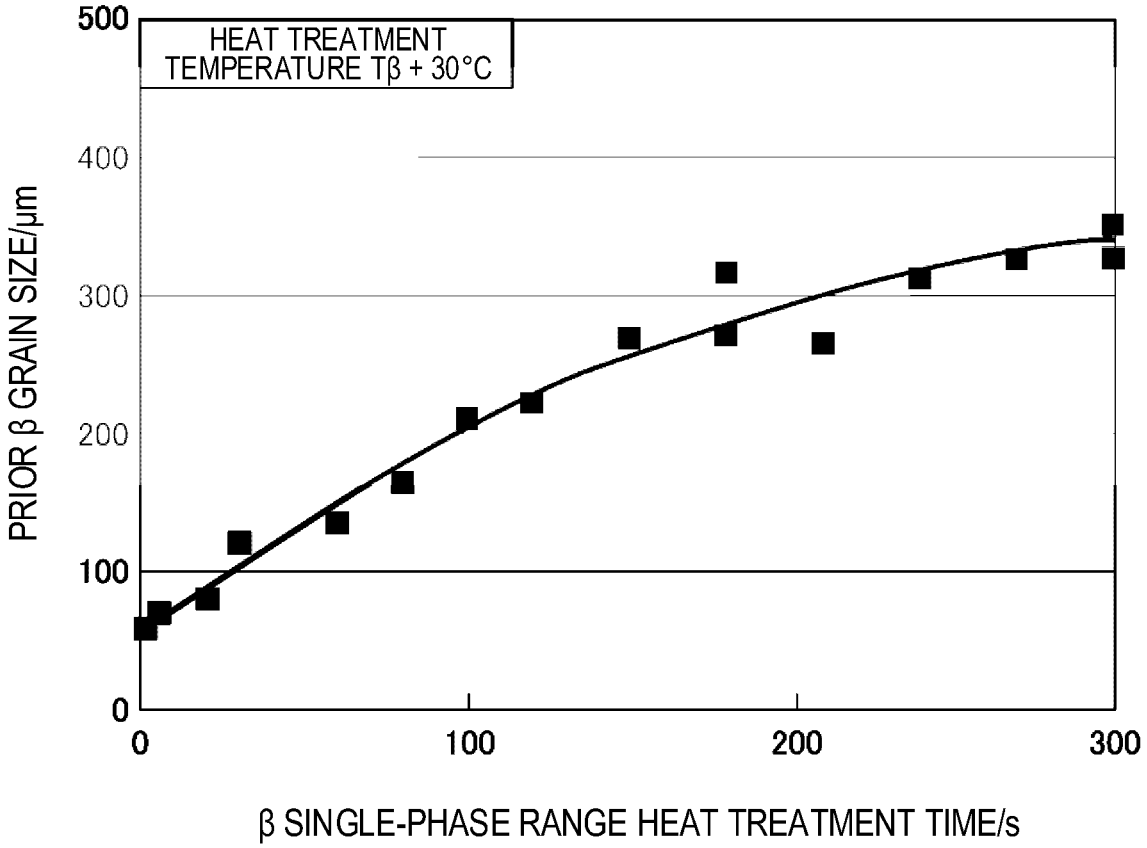
FIG. 4 is a chart illustrating an effect of a β single-phase range heat treatment time on the β grain size (prior β grain size).

FIG. 4 illustrates an effect of the heating time on the β grain size when the heating to the β single-phase range (β single-phase range heat treatment) is performed. The longer the β single-phase range heat treatment time, the larger the β grain size (prior β grain size) becomes. This is because, the coalescence of the β grains starts so as to decrease the surface energy of the β grains as the holding time at the β transus temperature or higher is longer.

Further, the β grain size in the case where the β single-phase range heat treatment is performed increases as the heating temperature becomes higher. This is because, as the heating temperature becomes higher, a diffusion length of the elements in the metal increases and accordingly a moving speed of interfaces of the β grains increases.

Figure 5:
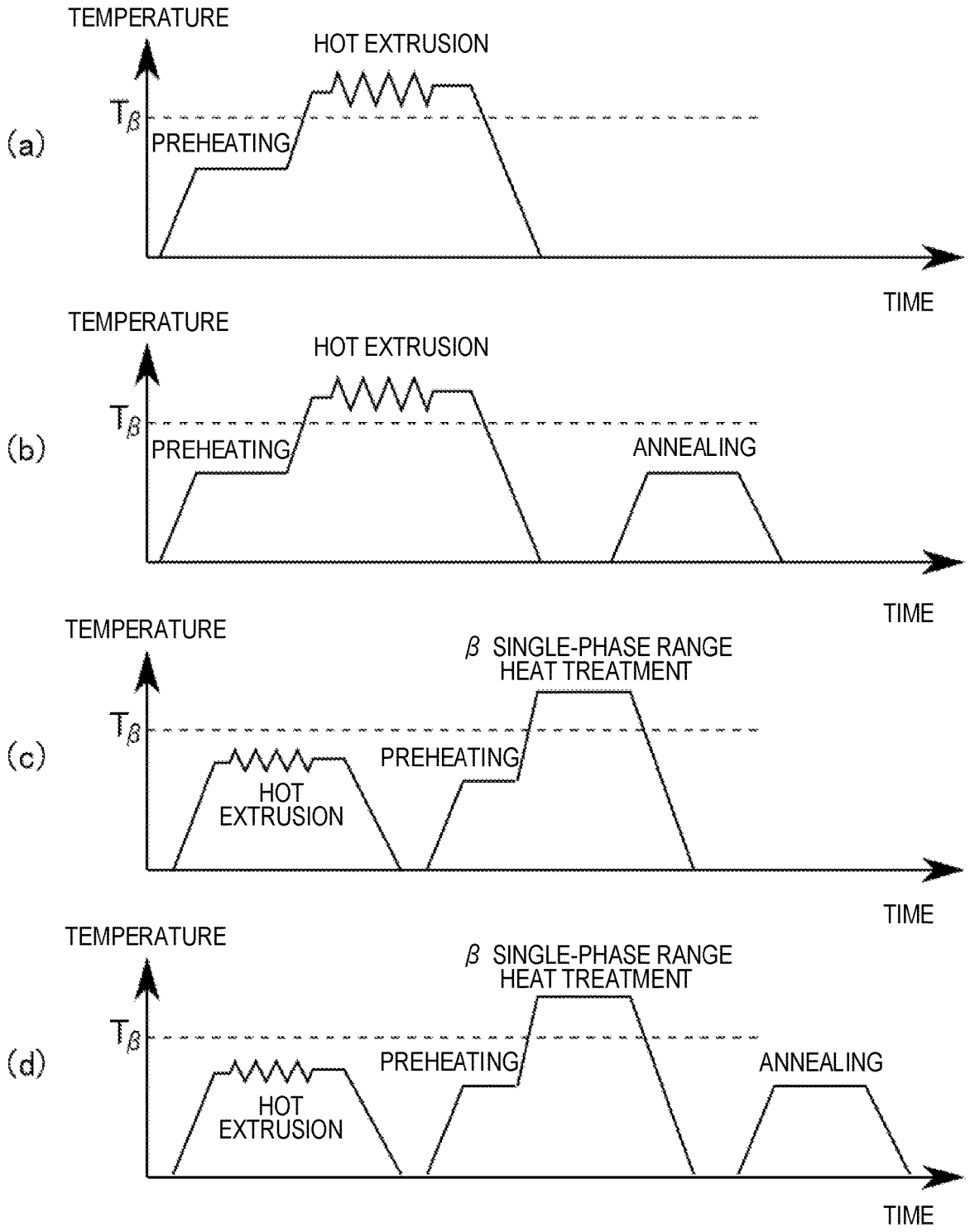
FIGS. 5 (*a*) to (*d*) are graphs each illustrating a heat history exemplifying a method of manufacturing the α+β titanium alloy extruded shape of the present invention.

Therefore, regarding the manufacturing methods illustrated in FIG. 5, the present inventors investigated a relation between temperature conditions during the manufacture and the β grain size (prior β grain size), and have found out conditions under which the average β grain size (prior β grain size) becomes 250 μm or less. It should be noted that these are only examples, and the α+β titanium alloy extruded shape of the present invention is not limited to one obtained by any of these methods.

In FIG. 5, (a) is a manufacturing method in which the acicular microstructure is obtained by hot extrusion in a temperature range of the β transus temperature ($T_\beta$) or higher, (b) is a manufacturing method in which the acicular microstructure is obtained by hot extrusion in a temperature range of the β transus temperature ($T_\beta$) or higher, further followed by diffusion annealing for diffusing atoms of V and Fe, (c) is a manufacturing method in which hot extrusion in a temperature range of lower than the β transus temperature ($T_\beta$) is performed, followed by (3 single-phase range heat treatment for obtaining the acicular microstructure, and (d) is a manufacturing method in which hot extrusion in a temperature range of lower than the β transus temperature ($T_\beta$) is performed, followed by β single-phase range heat treatment for obtaining the acicular microstructure, and further followed by diffusion annealing for diffusing atoms of V and Fe.

In the manufacturing method illustrated in FIG. 5(*a*), when a titanium alloy billet is heated to the β transus temperature or higher and subjected to the hot extrusion, it is necessary that both the surface and the center of the billet have been homogeneously heated at a predetermined temperature equal to or higher than the β transus temperature. Since titanium is low in heat conductivity, in order to homogeneously heat the titanium alloy billet at the predetermined temperature, a heating rate during the heating is set low or a residence time in a heating furnace is set long in order for the billet up to the center to reach the aimed temperature. When an attempt is made to make the billet up to the center reach the aimed temperature, the surface of the billet reaches the β transus temperature or higher earlier than its center, and accordingly its holding time after it reaches the β transus temperature or high is long. As a result, in the billet surface, the growth of the β grains is promoted, resulting in an increase in the β grains before the extrusion. When the β grains before the extrusion become coarse, there are a small number of recrystallization nucleation sites of the β grains after the extrusion, so that the β grains after the extrusion also become coarse, and the average prior β grain size exceeds 250 μm, and 0.2% proof stress deteriorates as illustrated in FIG. 3.

Under such circumstances, we have come up with a method which preheats the billet to homogeneously heat it at a predetermined temperature equal to or lower than the β transus temperature, thereafter rapidly heats it until the whole billet has a predetermined temperature equal to or higher than the β transus temperature, thereby shortening the holding time at the temperature at β transus temperature or higher, and hot extrusion is performed. In the preheating, since the billet is homogeneously heated at the temperature equal to or lower than the β transus temperature, the β grains do not become coarse. Owing to the preheating, the rapid heating can be performed thereafter, and when the billet center reaches the predetermined temperature equal to or higher than the β transus temperature, it is possible to shorten the holding time of the surface of the billet at the β transus temperature or higher. As a result, it is possible to prevent the β grains before the extrusion from becoming coarse in the billet including its surface, and is also possible to prevent the β grains after the extrusion from becoming coarse, making it possible for the average prior β grain size to be 250 μm or less.

The preheating is performed such that the temperatures of the surface and center of the billet become ($T_\beta$−500) to ($T_\beta$−80)° C. and a temperature difference between the surface and the center becomes 50° C. or less.

If the billet temperature after the preheating is too low, in order to heat the billet up to the center to the predetermined β transus temperature or higher by the subsequent rapid heating, it is necessary to increase the holding time after the rapid heating, resulting in an increase in the holding time of the billet surface at the β transus temperature or higher to make the β grains coarse. In the present invention, by setting a lower limit of the preheating temperature to ($T_\beta$−500)° C., it is possible to shorten the holding time after the rapid heating, making it possible for the average prior β grain size after the extrusion to be 250 μm or less.

Titanium readily oxidizes when heated in the atmosphere, and when it is heated to a certain temperature or higher, a hardened layer called an α case is formed on its surface, and the thickness of the hardened layer becomes larger as the heating temperature becomes higher. Being hard and lacking ductility, the α case becomes a starting point of a crack during the extrusion to cause a crack in an extruded product. Further, a grinding operation of the surface hardened layer greatly wears out the die, leading to a large variation in sectional dimension in the longitudinal direction of the extruded material. Therefore, ($T_\beta$−80)° C. at which the formation of the α case is not noticeable is set as an upper limit of the preheating temperature.

Since titanium is low in heat conductivity, the whole billet is not uniformly heated if, after the preheating, the billet is rapidly heated from its surface in a state where the billet is not sufficiently homogeneously heated. Therefore, an upper limit of the temperature difference between the surface and the center of the billet at the time of the preheating is set to 50° C. so as to shorten the time until the whole billet reaches the β transus temperature after part of the billet reaches the β transus temperature at the time of the rapid heating, and so as to prevent the prior β grain size after the extrusion from exceeding 250 μm which is the upper limit of the average prior β grain size in the cross section. In actual operation, the temperature difference is preferably 20° C. or less.

After preheated, the billet is heated to $T_\beta$ to ($T_\beta$+200)° C. at a heating rate of 1.0° C./s or more by electrical heating or induction heating, and thereafter is subjected to the extrusion work.

The higher the billet temperature after the rapid cooling, the more the prior β grain size increases. This is because the β grains having undergone the work during the extrusion recrystallize while kept at the β transus temperature or higher after the extrusion, and as the billet temperature before the extrusion is higher, the holding time at the β transus temperature or higher after the extrusion becomes longer and the grain growth time after the recrystallization becomes longer. It has been found out that, if the billet temperature after the rapid heating exceeds the β transus temperature+200° C., the average prior β grain size of the extruded shape exceeds 250 μm and 0.2% proof stress becomes lower than 830 MPa. Further, titanium readily oxidizes when heated in the atmosphere, and when it is heated to a certain temperature or higher, a hardened layer called an α case is formed on its surface, and the thickness of the hardened layer becomes larger as the heating temperature becomes higher. Being hard and lacking ductility, the α case becomes a starting point of a crack during the extrusion to cause a crack in an extruded product. Further, a grinding operation of the surface hardened layer greatly wears out the die, leading to a large variation in sectional dimension in the longitudinal direction of the extruded material. Therefore, $(T_\beta+200)$° C. at which the average prior β grain size becomes 250 μm or less and the formation of the α case is not noticeable is set as an upper limit of the preheating temperature. On the other hand, if the temperature after the rapid heating is close to the β transus temperature ($T_\beta$), the surface layer region of the extruded shape has the equiaxed microstructure since its working temperature decreases to $T_\beta$ or lower due to heat removal when it comes into contact with the die during the extrusion. As the extrusion progresses, the temperature of the die increases and the working temperature of the extruded shape surface layer also increases, and a constant region has the acicular microstructure, but to manufacture the extruded shape stably having the acicular microstructure, the temperature after the rapid cooling is preferably $(T_\beta+50)$° C. or higher.

If the heating rate during the rapid heating of the billet before the extrusion is low, the billet surface is kept at the temperature equal to or higher than the β transus temperature for a long time and has a large prior β grain size before the extrusion and has a large prior β grain size also after the extrusion. Therefore, a lower limit of the heating rate is set to 1.0° C./s which inhibits the growth of the β grains of the billet surface before the extrusion and gives the average prior β grain size of 250 μm or less after the extrusion.

Since titanium is poor in heat conductivity, when the rapid heating by the electrical heating or the induction heating is performed, a predetermined holding time is preferably provided after the rapid heating in order for the whole billet to be uniformly heated. In order for the whole billet to be heated to the temperature equal to or higher than the β transus temperature, the billet is desirably retained for 20 seconds or more after the rapid heating. On the other hand, too long a holding time after the rapid heating is not preferable because this makes the β grains coarse during the holding time, and also makes the β grains after the extrusion coarse. In the present invention, the holding time after the rapid heating is set to 150 seconds or less, which makes it possible for the average prior β grain size of the extruded shape to be 250 μm or less as illustrated in FIG. 4.

The extrusion work is followed by standing-to-cool to room temperature at a cooling rate of less than 5° C./second. The cooling rate mentioned here refers to a rate of cooling to 500° C. If forced cooling at 5° C./second or more is performed after the extrusion, the cooling rate becomes nonuniform, and stress ascribable to a temperature difference in the extruded shape is generated in the extruded shape, causing plastic deformation such as a warp and a bend. Even if the plastic deformation does not occur, residual stress is generated in the extruded shape after the cooling to the room temperature, giving a defective shape such as a warp at the time of the machining, cutting, and so on of the extruded shape. Therefore, the extrusion work is followed by the standing-to-cool at the cooling rate of less than 5° C./second. Further, a low cooling rate causes the grain boundary α phase to grow during the cooling to deteriorate ductility. Therefore, the cooling rate in the standing-to-cool after the extrusion work is set to 0.5° C./second or more. In actual operation, the standing-to-cool (about PC/second) is preferable.

Further, as in the manufacturing method illustrated in FIG. 5(*b*), the standing-to-cool may be followed by the diffusion annealing at $(T_\beta-500)$ to $(T_\beta-200)$° C. for diffusing the atoms of V and Fe.

Performing the standing-to-cool after the extrusion lowers the temperature of the extruded shape to a temperature range at which the solid-solution elements do not diffuse, resulting in almost no diffusion of the solid-solution elements. Accordingly, the compositions of the α and β phases become close to the compositions in an equilibrium state at 800 to 900° C. near the β transus temperature. As a result, in the extruded shape left standing-to-cool to the room temperature after the extrusion, the concentrations of V and Fe contained in the β phase are low, and the solid-solution strengthening of the β phase governing the strength of the extruded shape has not taken place sufficiently.

Therefore, in the present invention, the extruded shape which has undergo the standing-to-cool is annealed for a time long enough for the atoms to diffuse and reach the equilibrium state, thereby promoting the diffusion of the atoms of V and Fe which are the β stabilizing elements, and the concentrations of V and Fe contained in the β phase are increased, thereby sufficiently causing the solid-solution strengthening, which makes it possible to achieve a further increase in the strength of the extruded shape. At this time, a lower limit of the annealing temperature is set to $(T_\beta-500)$° C. so that the time required for diffusing V and Fe can be long enough, the distribution of the additive elements to the α and β phases progresses, the average ratio of the concentrations of V contained in the side plate α phase and the side plate β phase becomes 0.24 or less, and the average concentration of Fe contained in the side plate β phase becomes 1.13% or more in the colony, and thus sufficiently high 0.2% proof stress is obtained. If the annealing is performed at a temperature of lower than $(T_\beta-500)$° C., it is presumed that the V diffusion velocity is low, and the concentration ratio of V contained in the side plate α phase and the side plate β phase in the colony changes little before and after the annealing.

On the other hand, as the annealing temperature becomes higher, the fraction of the β phase increases, and accordingly the concentrations of V and Fe contained in the β phase reduce during the annealing, and in the subsequent standing-to-cool, almost no element diffusion takes place due to a short cooling time, so that the concentrations of V and Fe solid-dissolved in the β phase changes little before and after the annealing. Therefore, an upper limit of the annealing temperature is set to $(T_\beta-200)$° C. at which the fraction of the β phase is not high and the concentrations of V and Fe solid-dissolved in the β phase by the annealing increases.

Next, in the manufacturing method illustrated in FIG. 5(*c*), the titanium alloy billet is heated to $(T_\beta-200)$° C. to the β transus temperature ($T_\beta$) and hot-extruded, and thereafter the β single-phase range heat treatment is performed in order to unify the microstructure of the extruded shape to the acicular microstructure. The extrusion manufacturing process has characteristics of capable of high-efficiency manufacturing into a complicated sectional shape. However, in the extrusion at around the β transus temperature, in a region undergoing high-speed hard working, the working temperature easily exceeds the β transus temperature owing to large working heat generation, and the acicular microstructure is obtained. Therefore, in the extrusion manufacturing process, the extruded shape is shaped, and in the subsequent β single-phase range heat treatment, the microstructure and mechanical properties are controlled.

If the temperature at the time of the extrusion is too low, the hot deformation resistance of the α+β titanium alloy rapidly increases, necessitating a large extrusion press capable of applying a high extrusion load, leading to a facility cost increase. Further, in a hot extrusion work at a lower temperature, in particular, at $(T_\beta-200)°$ C. or lower, the α+β titanium alloy greatly deteriorates in hot ductility and thus is likely to suffer a surface defect such as a crack, which will be a cause to decrease yields. At this time, a thin flange region or the like whose temperature easily decreases is likely to first decrease in temperature to $(T_\beta-200)°$ C. or lower and is likely to suffer a crack or a flaw. Therefore, a lower limit of the billet heating temperature is set to $(T_\beta-200)°$ C. at which the hot deformation resistance is not very large and a crack or a flaw does not occur during the extrusion even if the temperature locally decreases.

If the extrusion temperature is equal to or higher than the β transus temperature, the microstructure obtained after the extrusion is the acicular microstructure, necessitating no microstructure control by the β single-phase range heat treatment. Therefore, an upper limit of the extrusion temperature in this manufacturing method is set to the (3 transus temperature $(T_\beta+100)°$ C.

The extrusion work is followed by standing-to-cool to room temperature at a cooling rate of less than 5° C./second. If forced cooling at a 5° C./second or more is performed after the extrusion, stress ascribable to a difference in the cooling rate is generated in the extruded shape to cause plastic deformation such as a warp and a bend. Further, even if the plastic deformation does not occur, residual stress is generated in the extruded shape after the cooling to the room temperature, causing a defective shape such as warp at the time of the machining, cutting, and so on of the extruded shape. Therefore, the cooling rate of the standing-to-cool after the extrusion work is less than 5° C./second. Further, if the cooling rate is low, the grain boundary α phase grows during the cooling to deteriorate ductility. Therefore, the cooling rate of the standing-to-cool after the extrusion work is 0.5° C./second or more. In actual operation, the standing-to-cool (about PC/second) is preferable.

In the manufacturing method illustrated in FIG. 5(*c*), most part of the extruded shape is subjected to the extrusion work in the temperature range of lower than the β transus temperature ($T_\beta$), and accordingly the microstructure after the extrusion work is the equiaxed microstructure. However, in a region where the working amount is large and heat removal by the contact with the tool is small, such as the inside of the extruded shape, the working temperature exceeds the β transus temperature, and thus the microstructure after the extrusion work becomes the acicular microstructure. Such mixed presence of the acicular microstructure and the equiaxed microstructure inside the extruded shape causes a mechanical property difference ascribable to the microstructures in the extruded shape to cause stress concentration in an acicular microstructure region which is a region inferior in the mechanical property, possibly causing a crack and brittle fracture.

Therefore, in order to unify the microstructure of the extruded shape to the acicular microstructure, the β single-phase range heat treatment whose lower limit temperature is the β transus temperature $T_\beta$ is performed after the extrusion. The heating to the β transus temperature $T_\beta$ or higher causes the whole to transform to the β phase, so that the acicular microstructure is obtained after the cooling.

However, as the β single-phase range heat treatment temperature becomes higher, the atom diffusion velocity increases to increase the growth rate of the β grains, and the time required for cooling to the β transus temperature or lower increases, so that the growth of the β grains is promoted. As a result, if the β single-phase range heat treatment temperature is too high, the β grain size (prior β grain size) becomes larger than 250 μm and the piled-up length of the dislocation increases to increase the stress concentration occurring on the colony boundary, so that 0.2% proof stress greatly deteriorates. Therefore, an upper limit temperature of the β single-phase range heat treatment is set to $(T_\beta+200)°$ C. so as to prevent the growth rate of the β grains from becoming too high and so as to shorten the cooling time to the β transus temperature or lower.

Further, to prevent the β grain size (prior β grain size) of the acicular microstructure region from becoming large, the heating time of the β single-phase range heat treatment is also important. FIG. 4 illustrates an effect of the heating time on the β grain size when the β single-phase range heat treatment is performed. As the β single-phase range heat treatment time becomes longer, the β grain size (prior β grain size) increases. This is because, if the holding time at the β transus temperature or higher is long, the coalescence of the β grains starts so as to decrease the surface energy of the β grains. Further, titanium readily oxidizes when heated in the atmosphere, and when it is heated to a certain temperature or higher, a hardened layer called an α case is formed on its surface, and the thickness of the hardened layer is larger as the heating temperature is higher. Being hard and lacking ductility, the α case becomes a starting point of a crack to cause a crack in an extruded product. Therefore, by keeping the extruded shape for 200 seconds or less at $T_\beta$° C. or higher (β single-phase range heat treatment temperature) at which the average β grain size (prior β grain size) becomes 250 μm or less and the formation of the α case is not noticeable, it is possible to control all the equiaxed microstructure regions to the acicular microstructure without making the prior β grain size of the acicular microstructure region large. On the other hand, a lower limit of the β single-phase range heat treatment time, though depending on the thickness of the extruded shape, is preferably about 10 seconds which is long enough to heat the whole to the β transus temperature or higher, in consideration of the heat transfer time to the center region of the extruded shape.

Further, in the case where the β single-phase range heat treatment is thus performed as well, it is necessary for both the surface and the center of the billet to reach a predetermined uniform temperature equal to or lower than the β transus temperature in the preheating. Therefore, as previously described, in the case where the β single-phase range heat treatment is performed as well, the preheating for homogeneously heating the billet at the predetermined temperature equal to or lower than the β transus temperature is performed, thereafter the rapid heating is performed to increase the temperature of the whole billet to a predetermined temperature equal to or higher than the β transus temperature, thereby shortening the holding time at the β transus temperature or higher, and the β single-phase range heat treatment is performed. Consequently, the average prior β grain size can be 250 μm or less.

Then, the β single-phase range heat treatment is followed by standing-to-cool to room temperature at a cooling rate of less than 5° C./second. This prevents plastic deformation such as a warp and a bend, resulting in no generation of residual stress in the extruded shape.

Further, as in the manufacturing method illustrated in FIG. 5(*d*), the standing-to-cool may be followed by the diffusion annealing at ($T_\beta$−500) to ($T_\beta$−200)° C. for diffusing the atoms of V and Fe. Consequently, V and Fe are solid-dissolved in the β phase to improve the strength of the β phase (solid-solution strengthening). As a result, 0.2% proof stress becomes strength of still larger than 830 MPa which is considered as high strength.

It should be noted that the α+β titanium alloy extruded shape of the present invention is not obtained only by these manufacturing methods as described above. For example, in the manufacturing methods illustrated in FIGS. 5(*c*) and (*d*), the extrusion work may be performed at the β transus temperature or higher. Further, the diffusion annealing may be continuously performed during the cooling after the extrusion work and during the cooling after the β single-phase range heat treatment.

EXAMPLES

Ti-6A-4V ingots with ϕ700 mm, a 5 ton weight, and the component compositions of the alloys No. 1 to 3 shown in Table 1, which were obtained through double vacuum arc remelting, were hot-forged in an α+β temperature range until an area reduction ratio became 60%, and surface oxide layers of the obtained billets were cut, whereby billets to be extruded were fabricated. Using these billets, extruded shapes each having the protruding sectional shape illustrated in FIG. 6 were produced.

TABLE 1

| ALLOY | CHEMICAL COMPONENTS OF BILLET (mass %) | | | | | | | β TRANSUS TEMPERATURE |
|---|---|---|---|---|---|---|---|---|
| No. | Al | V | Fe | O | C | N | H | (° C.) |
| 1 | 6.12 | 4.32 | 0.11 | 0.15 | 0.012 | 0.011 | 0.0001 | 996 |
| 2 | 6.30 | 4.20 | 0.15 | 0.12 | 0.010 | 0.010 | 0.0002 | 995 |
| 3 | 6.42 | 4.04 | 0.17 | 0.18 | 0.008 | 0.009 | 0.00021 | 1002 |

Example 1

First, Example 1 regarding the manufacturing conditions described in FIGS. 5(*a*) and (*b*) was carried out. Table 2 shows manufacturing conditions in Example 1. In the invention examples (test No. 4 to 15) in Example 1 (Table 2), after the aforesaid billets were preheated to 600° C. (a temperature difference between the surface and the center was 5° C.) in an Ar gas atmosphere, they were heated to $T_\beta$ to ($T_\beta$+200)° C. by induction heating and subjected to an extrusion work, and thereafter were left standing-to-cool at a cooling rate of 1.7° C./second. In the invention examples (test No. 7 to 9, 13 to 15), hot-extruded shapes were further diffusion-annealed (the manufacturing condition in FIG. 5(*b*)).

On the other hand, in the comparative examples (test No. 1 to 3) of Example 1 (Table 2), the aforesaid billets were heated to $T_\beta$ to ($T_\beta$+200)° C. and subjected to an extrusion work, without undergoing the stepwise heating of the preheating and the induction heating, thereafter were left standing-to-cool, and were further diffusion-annealed. In the comparative examples (test No. 16 to 21) in Example 1 (Table 2), after the aforesaid billets were preheated to 600° C., they were heated to 1230° C. (higher than ($T_\beta$+200)) by induction heating and subjected to an extrusion work, and thereafter were left standing-to-cool. In the comparative examples (test No. 19 to 21), hot-extruded shapes were further diffusion-annealed. In the comparative examples (test No. 22 to 27) in Example 1 (Table 2), after the aforesaid billets were preheated to 600° C., they were heated to 980° C. (lower than $T_\beta$) by induction heating and subjected to an extrusion work, and thereafter were left standing-to-cool. In the comparative examples (test No. 25 to 27), hot-extruded shapes were further diffusion-annealed. In the comparative examples (test No. 28 to 30) in Example 1 (Table 2), the aforesaid billets were heated to $T_\beta$ to ($T_\beta$+200)° C. and subjected to an extrusion work, without undergoing the stepwise heating of the preheating and the induction heating, thereafter were forcibly cooled at a cooling rate of 300° C., and were further diffusion-annealed.

<Tensile Test>

Figure 6:
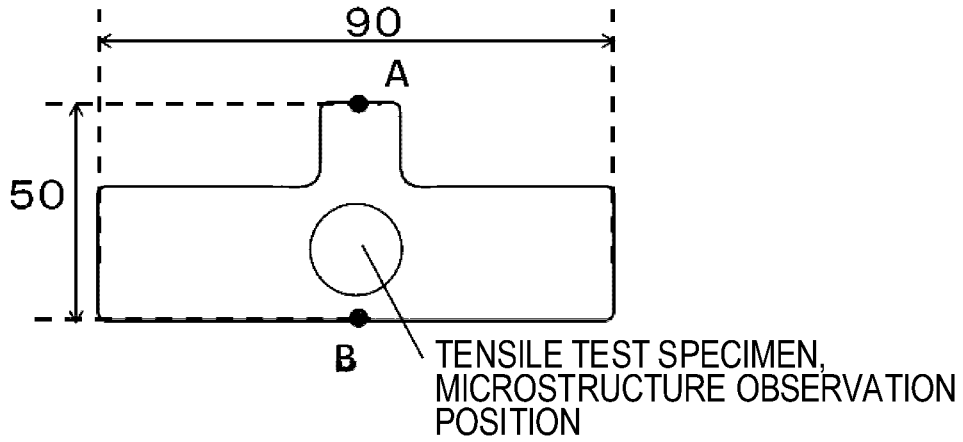
FIG. 6 is a schematic view of a sectional shape of an extruded shape produced in Example.

From the position indicated in FIG. 6 of each of the hot-extruded shapes, an ASTM E8 half-size tensile test specimen (reduced section measuring 6.35 diameter times 25 mm length) was obtained.

<Microstructure Observation Test>

From the same position as the sampling position of the tensile test specimens, microstructure observation specimens were taken, and the microstructures of their L cross sections were observed using optical microscope observation photographs. As the prior β grain size, a circle-equivalent diameter was measured by an intercept method, and an average in 3 mm×6 mm (the minimum number of grains: about 200) was found.

<Microstructure Distribution>

An equiaxed microstructure region and an acicular microstructure region can be identified by macrostructure observation. A macrostructure is divided into two regions, which are a region having a strong metallic luster and a region appearing white and having a low luster. In both of the regions, light reflected on surface irregularities formed by macro-etching produces the metallic luster. However, in a region containing fine equiaxed α grains, the surface irregularities are finer than in a region with the acicular microstructure to diffuse-reflect light. Accordingly, the region with the equiaxed microstructure appears whiter as compared with the region with the acicular microstructure. The microstructure distribution was examined in cross sections obtained when an extruded shape with a 4000 mm whole length was divided every 200 mm (including an end face of the extreme tip region).

<Warp>

Figure 7:
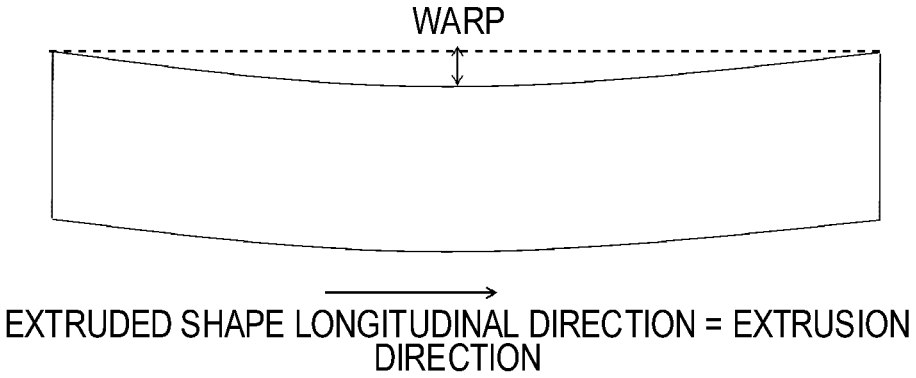
FIG. 7 is an explanatory view of "warp" of the extruded shape as measured in Example.

As for a warp, a distance of a center region of the extruded shape from a straight line connecting both longitudinal ends of the extruded shape was defined as a warp as illustrated in FIG. 7. Incidentally, in actual measurement, a string was attached to the points A (FIG. 6) at both ends of the extruded shape.

TABLE 2

| | | | MANUFACTURING METHOD | | | | | EXTRUDED SHAPE QUALITY | | | | | | | |
|---|---|---|---|---|---|---|---|---|---|---|---|---|---|---|---|
| TEST No. | CLASSIFICATION | ALLOY No. | PATTERN | PRE-HEATING TEMPERATURE/ ° C. | INDUCTION HEATING TEMPERATURE/ ° C. | COOLING RATE/ ° C. · $s^{-1}$ | ANNEALING TEMPERATURE/ ° C. | AVERAGE β GRAIN SIZE/μm | V CONCENTRATION RATIO | Fe CONCENTRATION IN β PHASE (mass %) | AVERAGE WIDTH OF GRAIN BOUNDARY α PHASE/ μm | 0.2% PROOF STRESS/ MPa | TENSILE STRENGTH/ MPa | ELONGATION (%) | MICRO STRUCTURE |
| 1 | COMPARATIVE EXAMPLE | 1 | — | 1080 | NOT PERFORMED | 1.7 | 700 | 2520 | 0.21 | 1.3 | 2.6 | 743 | 925 | 12.1 | ACICULAR |
| 2 | | 2 | — | 1080 | NOT PERFORMED | 1.7 | 700 | 3122 | 0.21 | 1.4 | 2.5 | 735 | 920 | 11.8 | ACICULAR |
| 3 | | 3 | — | 1080 | NOT PERFORMED | 1.7 | 700 | 2894 | 0.22 | 1.4 | 2.5 | 753 | 931 | 12.1 | ACICULAR |
| 4 | INVENTION EXAMPLE | 1 | a | 600 | 1030 | 1.7 | — | 132 | 0.28 | 0.9 | 2.4 | 845 | 956 | 14.5 | ACICULAR |
| 5 | | 2 | a | 600 | 1030 | 1.7 | — | 138 | 0.29 | 1.0 | 2.4 | 841 | 942 | 14.1 | ACICULAR |
| 6 | | 3 | a | 600 | 1030 | 1.7 | — | 122 | 0.24 | 0.9 | 2.2 | 838 | 964 | 14.2 | ACICULAR |
| 7 | | 1 | b | 600 | 1030 | 1.7 | 700 | 135 | 0.22 | 1.2 | 2.8 | 895 | 961 | 14.2 | ACICULAR |
| 8 | | 2 | b | 600 | 1030 | 1.7 | 700 | 131 | 0.21 | 1.3 | 2.7 | 872 | 949 | 14.8 | ACICULAR |
| 9 | | 3 | b | 600 | 1030 | 1.7 | 700 | 140 | 0.21 | 1.4 | 2.8 | 912 | 966 | 14.3 | ACICULAR |
| 10 | | 1 | a | 600 | 1150 | 1.7 | — | 220 | 0.27 | 1.0 | 2.5 | 832 | 964 | 14.5 | ACICULAR |
| 11 | | 2 | a | 600 | 1150 | 1.7 | — | 231 | 0.25 | 0.9 | 2.4 | 831 | 958 | 14.1 | ACICULAR |
| 12 | | 3 | a | 600 | 1150 | 1.7 | — | 235 | 0.25 | 0.9 | 2.6 | 831 | 962 | 14.4 | ACICULAR |
| 13 | | 1 | b | 600 | 1150 | 1.7 | 700 | 218 | 0.21 | 1.2 | 3.2 | 860 | 963 | 14.2 | ACICULAR |
| 14 | | 2 | b | 600 | 1150 | 1.7 | 700 | 227 | 0.21 | 1.2 | 3.5 | 855 | 955 | 14.3 | ACICULAR |
| 15 | | 3 | b | 600 | 1150 | 1.7 | 700 | 230 | 0.22 | 1.2 | 3.1 | 851 | 959 | 15.1 | ACICULAR |
| 16 | COMPARATIVE EXAMPLE | 1 | a | 600 | 1230 | 1.7 | — | 281 | 0.28 | 0.8 | 2.4 | 805 | 948 | 13.1 | ACICULAR |
| 17 | | 2 | a | 600 | 1230 | 1.7 | — | 285 | 0.27 | 1.0 | 2.8 | 806 | 951 | 13.4 | ACICULAR |
| 18 | | 3 | a | 600 | 1230 | 1.7 | — | 270 | 0.24 | 1.0 | 2.6 | 798 | 940 | 12.8 | ACICULAR |
| 19 | | 1 | b | 600 | 1230 | 1.7 | 700 | 275 | 0.21 | 1.4 | 3.9 | 825 | 945 | 12.8 | ACICULAR |
| 20 | | 2 | b | 600 | 1230 | 1.7 | 700 | 264 | 0.22 | 1.3 | 3.4 | 828 | 953 | 11.4 | ACICULAR |
| 21 | | 3 | b | 600 | 1230 | 1.7 | 700 | 278 | 0.23 | 1.3 | 3.6 | 821 | 945 | 12.1 | ACICULAR |
| 22 | | 1 | a | 600 | 980 | 1.7 | — | 105 | 0.28 | 1 | 2.4 | 899 | 982 | 18.3 | EQUIAXED + ACICULAR |
| 23 | | 2 | a | 600 | 980 | 1.7 | — | 100 | 0.28 | 1.0 | 2.8 | 873 | 975 | 19.1 | EQUIAXED + ACICULAR |
| 24 | | 3 | a | 600 | 980 | 1.7 | — | 82 | 0.25 | 0.9 | 2.4 | 905 | 989 | 16.8 | EQUIAXED + ACICULAR |
| 25 | | 1 | b | 600 | 980 | 1.7 | 700 | 110 | 0.21 | 1.4 | 3.1 | 895 | 978 | 17.8 | EQUIAXED + ACICULAR |
| 26 | | 2 | b | 600 | 980 | 1.7 | 700 | 107 | 0.22 | 1.3 | 2.8 | 870 | 970 | 18.5 | EQUIAXED + ACICULAR |
| 27 | | 3 | b | 600 | 980 | 1.7 | 700 | 100 | 0.22 | 1.2 | 2.2 | 900 | 980 | 15.9 | EQUIAXED + ACICULAR |
| 28 | | 1 | b | 1150 | — | 310 | 700 | 371 | 0.22 | 1.5 | 0.5 | 912 | 1010 | 15.5 | ACICULAR |
| 29 | | 2 | b | 1150 | — | 305 | 700 | 348 | 0.22 | 1.5 | 0.6 | 904 | 1007 | 14.9 | ACICULAR |
| 30 | | 3 | b | 1150 | — | 308 | 700 | 351 | 0.21 | 1.4 | 0.5 | 897 | 998 | 15.0 | ACICULAR |

The underline in Table 2 indicates that the relevant item falls out of the range of the present invention, and in Table 2, the pattern indicates any of FIGS. 5. (a) to (d), the cooling rate was measured at the position A indicated in FIG. 6, and the V concentration ratio is an average ratio of the concentration of V contained in a side plate α phase to the concentration of V contained in a β phase in a colony of the acicular microstructure. Incidentally, 830 MPa or more and 10% or more were defined as preferable ranges of 0.2% proof stress and elongation respectively.

In Example 1, in the test No. 1 to 3 as the comparative examples, since the billets were heated without undergoing the rapid heating, β grains became coarse before the extrusion and the number of recrystallization nucleation sites after the extrusion was small, and accordingly an average prior β grain size after the extrusion was also over 250 μm. Accordingly, the 0.2% proof stress was lower than 830 MPa.

In all of the test No. 16 to 21 as the comparative examples, since the billet temperature after the induction heating was higher than 1200° C., β grains grew at a billet stage before the extrusion. Due to the resultant reduction in the number of recrystallization nucleation sites after the extrusion, the average prior grain size was over 250 μm and the 0.2% proof stress was lower than 830 MPa.

In the test No. 22 to 27 as the comparative examples, the billet temperature after the induction heating was equal to or lower than the (3 transus temperature (1000° C.). Accordingly, an extrusion leading end region had the equiaxed microstructure due to heat removal by its contact with the die. In an extrusion trailing end, most parts in the cross section had the equiaxed microstructure, though the acicular microstructure was observed in part of the center region of the extruded shape cross section owing to working heat generation. As described above, in each of the obtained extruded shapes, the acicular microstructure region was present only in a limited region, and the tensile test specimen sampling region contained the equiaxed microstructure. As a result, a higher tensile property than that of the acicular microstructure was exhibited. However, due to the mixed presence of the acicular microstructure and the equiaxed microstructure in the cross section, mechanical properties vary due to the metal microstructures in actual use.

The test No. 28 to 30 as the comparative examples are extruded shapes produced by a conventional method. Specifically, after the billets were heated to the β transus temperature or higher in a gas heating furnace, they were extruded, were forcibly cooled by water cooling, and thereafter were annealed. Their prior β grain size is larger than those in the test No. 4 to 15 of the present invention, but since the width of a grain boundary α phase is small, they have tensile properties comparable to those of the present invention. However, as will be described later, since the cooling rate is higher than that of the present invention, the extruded shape greatly warp and thus require post-treatment such as correction in actual use.

On the other hand, in the test No. 4 to 15 as the invention examples, the acicular microstructure in which the prior β grain size was 250 μm or less was obtained almost along the whole length. This is because, owing to the induction heating temperature of the billets being within the range of $T_\beta$ to $(T_\beta+200)$° C., the holding time at the β transus temperature or higher after the extrusion was short and the β grains did not become coarse. Further, in the test No. 4 to 9, since the prior β grain size was 180 μm or less, the 0.2% proof stress was much larger than 830 MPa. Further, in the test No. 7 to 9 and 13 to 15 of the present invention, the interphase V concentration ratio was 0.24 or less, and the Fe concentration in the β phase was 1.13% or more. This is because, as a result of the annealing in the temperature range of $(T_\beta-500)$ to $(T_\beta-200)$° C., the diffusion of the V and Fe elements was promoted during the annealing. As a result, the 0.2% proof stress was much higher than 830 MPa. However, in each of the test No. 4 to 9 of the present invention, the equiaxed microstructure was observed in a surface layer region at an extrusion leading end region which is an inconstant region. This is because the temperature of the die was low at the start of the extrusion, and at the leading end region of the billet, the working temperature was lower than the β transus temperature due to heat removal by the contact of the billet with the die during the extrusion. On the other hand, in the trailing end region of the extruded shape, the working temperature of the billet increased to the β transus temperature or higher due to the working to heat generation accompanying the extrusion work, so that the acicular microstructure was obtained.

Example 2

Next, Example 2 regarding the manufacturing conditions described in FIGS. 5(*c*) and (*d*) was carried out. Table 3 shows manufacturing conditions in Example 2. In the invention examples (test No. 7 to 15) in Example 2 (Table 3), after the aforesaid billets were heated to 900° C. ($(T_\beta-200)$° C. to the β transus temperature ($T_\beta$)) and subjected to an extrusion work, they were subjected to 10-second or 120-second β single-phase range heat treatment by being heated to 1030° C., and thereafter were left standing-to-cool at a cooling rate of 1.7° C./second. In the invention examples (test No. 13 to 15), hot extruded shapes were further diffusion-annealed (the manufacturing condition in FIG. 5(*d*)).

On the other hand, in the comparative examples (test No. 1 to 3) of Example 2 (Table 3), after the aforesaid billets were heated to 900° C. ($(T_\beta-200)$° C. to the β transus temperature ($T_\beta$)) and subjected to an extrusion work, they were left standing-to-cool without undergoing the β single-phase range heat treatment. In the comparative examples (test No. 4 to 6) in Example 2 (Table 3), after the aforesaid billets were heated to 900° C. ($(T_\beta-200)$° C. to the β transus temperature ($T_\beta$)) and subjected to an extrusion work, they were heat-treated by being heated to 950° C. (lower than $T_\beta$), and thereafter were left standing-to-cool. In the comparative examples (test No. 16 to 21) in Example 2 (Table 3), after the aforesaid billets were heated to 900° C. ($(T_\beta-200)$° C. to the β transus temperature ($T_\beta$)) and subjected to an extrusion work, they were subjected to 250-second β single-phase range heat treatment by being to heated to 1030° C., and thereafter were left standing-to-cool. In the comparative examples (test No. 19 to 21), hot-extruded shapes were further diffusion-annealed. In the comparative examples (test No. 22 to 24) in Example 2 (Table 3), after the aforesaid billets were heated to 1050° C. (higher than $T_\beta$) and subjected to an extrusion work, they were subjected to 10-second β single-phase range heat treatment by being heated to 1030° C., and thereafter were left standing-to-cool. In the comparative examples (test No. 25 to 27) in Example 2 (Table 3), after the aforesaid billets were heated to 900° C. ($(T_\beta-200)$° C. to the β transus temperature ($T_\beta$)) and subjected to an extrusion work, they were subjected to 250-second β single-phase range heat treatment by being heated to 1030° C., thereafter were forcibly cooled at a cooling rate of 300° C./second, and were further diffusion-annealed.

TABLE 3

| | | | MANUFACTURING METHOD | | | | | | |
|---|---|---|---|---|---|---|---|---|---|
| | | | | PRE-HEATING | INDUCTION HEATING | β SINGLE-PHASE RANGE HEAT TREATMENT | | | ANNEALING |
| TEST No. | CLASSIFICATION | ALLOY No. | PATTERN | TEMPERATURE/ ° C. | TEMPERATURE/ ° C. | TEMPERATURE/ ° C. | TIME/s | COOLING RATE/ ° C. · $s^{-1}$ | TEMPERATURE/ ° C. |
| 1 | COMPARATIVE EXAMPLE | 1 | — | 600 | 900 | WITHOUT β SINGLE-PHASE RANGE HEAT TREATMENT | | 1.7 | — |
| 2 | | 2 | — | 600 | 900 | WITHOUT β SINGLE-PHASE RANGE HEAT TREATMENT | | 1.7 | — |
| 3 | | 3 | — | 600 | 900 | WITHOUT β SINGLE-PHASE RANGE HEAT TREATMENT | | 1.7 | — |
| 4 | | 1 | — | 600 | 900 | 950 | 100 | 1.7 | — |
| 5 | | 2 | — | 600 | 900 | 950 | 100 | 1.7 | — |
| 6 | | 3 | — | 600 | 900 | 950 | 100 | 1.7 | — |
| 7 | INVENTION EXAMPLE | 1 | c | 600 | 900 | 1030 | 120 | 1.7 | — |
| 8 | | 2 | c | 600 | 900 | 1030 | 120 | 1.7 | — |
| 9 | | 3 | c | 600 | 900 | 1030 | 120 | 1.7 | — |
| 10 | | 1 | c | 600 | 900 | 1030 | 10 | 1.7 | — |
| 11 | | 2 | c | 600 | 900 | 1030 | 10 | 1.7 | — |
| 12 | | 3 | c | 600 | 900 | 1030 | 10 | 1.7 | — |
| 13 | | 1 | d | 600 | 900 | 1030 | 120 | 1.7 | 700 |
| 14 | | 2 | d | 600 | 900 | 1030 | 120 | 1.7 | 700 |
| 15 | | 3 | d | 600 | 900 | 1030 | 120 | 1.7 | 700 |
| 16 | COMPARATIVE EXAMPLE | 1 | c | 600 | 900 | 1030 | 250 | 1.7 | — |
| 17 | | 2 | c | 600 | 900 | 1030 | 250 | 1.7 | — |
| 18 | | 3 | c | 600 | 900 | 1030 | 250 | 1.7 | — |
| 19 | | 1 | d | 600 | 900 | 1030 | 250 | 1.7 | 700 |
| 20 | | 2 | d | 600 | 900 | 1030 | 250 | 1.7 | 700 |
| 21 | | 3 | d | 600 | 900 | 1030 | 250 | 1.7 | 700 |
| 22 | | 1 | c | 600 | 1050 | 1030 | 10 | 1.7 | — |
| 23 | | 2 | c | 600 | 1050 | 1030 | 10 | 1.7 | — |
| 24 | | 3 | c | 600 | 1050 | 1030 | 10 | 1.7 | — |
| 25 | | 1 | — | 600 | 900 | 1030 | 250 | 300 | 700 |
| 26 | | 2 | — | 600 | 900 | 1030 | 250 | 300 | 700 |
| 27 | | 3 | — | 600 | 900 | 1030 | 250 | 300 | 700 |

| | EXTRUDED SHAPE QUALITY | | | | | | | |
|---|---|---|---|---|---|---|---|---|
| TEST No. | AVERAGE β GRAIN SIZE/ μm | V CONCENTRATION RATIO | Fe CONCENTRATION IN β PHASE (mass %) | AVERAGE WIDTH OF GRAIN BOUNDARY α PHASE/ μm | 0.2% PROOF STRESS/ MPa | TENSILE STRENGTH/ MPa | ELONGATION (%) | MICRO STRUCTURE |
| 1 | 75 | 0.28 | 0.9 | 2.2 | 885 | 990 | 18.3 | EQUIAXED + ACICULAR |
| 2 | 72 | 0.26 | 1.0 | 2.6 | 890 | 981 | 18.1 | EQUIAXED + ACICULAR |
| 3 | 71 | 0.27 | 0.9 | 2.4 | 884 | 985 | 17.5 | EQUIAXED + ACICULAR |
| 4 | 74 | 0.26 | 0.8 | 2.8 | 880 | 992 | 19.0 | EQUIAXED + ACICULAR |
| 5 | 80 | 0.25 | 1.0 | 2.7 | 889 | 979 | 18.5 | EQUIAXED + ACICULAR |
| 6 | 75 | 0.25 | 0.9 | 2.4 | 875 | 980 | 18.1 | EQUIAXED + ACICULAR |
| 7 | 220 | 0.25 | 0.9 | 2.4 | 831 | 954 | 14.2 | ACICULAR |
| 8 | 241 | 0.25 | 0.8 | 2.8 | 834 | 960 | 14.0 | ACICULAR |
| 9 | 226 | 0.27 | 1.0 | 2.7 | 830 | 955 | 13.8 | ACICULAR |
| 10 | 151 | 0.26 | 0.9 | 2.2 | 850 | 954 | 14.1 | ACICULAR |
| 11 | 137 | 0.28 | 0.9 | 2.6 | 845 | 961 | 14.8 | ACICULAR |
| 12 | 133 | 0.24 | 1.0 | 2.8 | 858 | 960 | 13.9 | ACICULAR |
| 13 | 210 | 0.20 | 1.2 | 2.4 | 841 | 955 | 14.7 | ACICULAR |
| 14 | 208 | 0.21 | 1.4 | 2.5 | 844 | 962 | 15.0 | ACICULAR |
| 15 | 215 | 0.21 | 1.2 | 2.3 | 837 | 968 | 14.4 | ACICULAR |
| 16 | 304 | 0.26 | 0.9 | 2.5 | 785 | 925 | 12.5 | ACICULAR |
| 17 | 278 | 0.26 | 1.0 | 2.4 | 791 | 921 | 12.2 | ACICULAR |
| 18 | 311 | 0.28 | 0.9 | 3.1 | 801 | 933 | 13.1 | ACICULAR |
| 19 | 285 | 0.24 | 1.2 | 2.4 | 814 | 921 | 12.1 | ACICULAR |
| 20 | 330 | 0.21 | 1.1 | 2.6 | 825 | 924 | 11.8 | ACICULAR |

TABLE 3-continued

| | | | | | | | | |
|---|---|---|---|---|---|---|---|---|
| 21 | 271 | 0.23 | 1.1 | 2.2 | 820 | 930 | 13.5 | ACICULAR |
| 22 | 385 | 0.26 | 0.9 | 3.1 | 780 | 918 | 12.1 | ACICULAR |
| 23 | 382 | 0.27 | 1.0 | 3.2 | 774 | 924 | 11.5 | ACICULAR |
| 24 | 401 | 0.25 | 0.8 | 3.1 | 750 | 920 | 11.7 | ACICULAR |
| 25 | 350 | 0.24 | 1.2 | 0.4 | 904 | 1002 | 15.1 | ACICULAR |
| 26 | 361 | 0.22 | 1.3 | 0.5 | 895 | 1015 | 14.8 | ACICULAR |
| 27 | 350 | 0.23 | 1.1 | 0.4 | 909 | 991 | 14.2 | ACICULAR |

In Example 2, in each of the test No. 1 to 3 and the test No. 4 to 6 as the comparative examples, since the β single-phase range heat treatment was not conducted after the extrusion in the former and the temperature in the β single-phase range heat treatment was not equal to or higher than $T_\beta$ in the latter, a surface layer of an extruded shape cross section had the equiaxed microstructure and a region with the acicular microstructure was observed in a center region of the extruded shape cross section. This is because, in the surface layer region, due to heat removal by the contact with the container and the die, the working temperature was equal to or lower than the β transus temperature (1000° C.) even with the working heat generation, whereas, in the center region, the working temperature increased to the β transus temperature or higher because of the absence of such heat removal. However, the acicular microstructure region was present only in a limited region, and the tensile test specimen sampling region contained the equiaxed microstructure. As a result, a higher tensile property than that of the acicular microstructure was exhibited. However, due to the mixed presence of the acicular microstructure and the equiaxed microstructure in the cross section, mechanical properties vary due to the metal microstructures in actual use.

In each of the test No. 16 to 21 and the test No. 22 to 24 as the comparative examples, since the β single-phase range heat treatment time was long in the former and the β single-phase range heat treatment was performed even though the induction heating temperature was higher than $T_\beta$ in the latter, the prior β grain size was over 250 μm and the 0.2% proof stress was lower than 830 MPa.

The test No. 25 to 27 as the comparison were produced in a manner that the extruded shapes resulting from the extrusion at the β transus temperature or lower were heated to the β transus temperature or higher in a gas heating furnace, were forcibly cooled by water cooling, and thereafter were annealed. Their prior β grain size is larger than those in the test No. 7 to 15 of the present invention, but since the width of a grain boundary α phase is small, they have tensile properties comparable to those of the present invention. However, as will be described later, since the cooling rate after the β single-phase range heat treatment is higher than that of the present invention, the extruded shape greatly warp and thus require post-treatment such as correction in actual use.

On the other hand, in the test No. 7 to 15 of the present invention, the acicular microstructure in which the prior β grain size was 250 μm or less was obtained almost along the whole length and the 0.2% proof stress was over 830 MPa. Further, in each of the test No. 10 to 12 and the test No. 13 to 15, since the prior β grain size was 180 μm or less in the former, and since the interphase V concentration ratio was 0.24 or less and the Fe concentration in the β phase was 1.13% or more in the latter, the 0.2% proof stress was much higher than 830 MPa.

Example 3

Next, studies were made on the cooling rate after the extrusion work. Table 4 shows manufacturing conditions and the qualities of extruded shapes. The cooling rate indicates a cooling rate from the maximum ultimate temperature to 500° C. at the center position A of an extruded shape upper surface and the center position B of an extruded shape lower surface.

In the invention examples (test No. 1 to 6) in Example 3 (Table 4), after the aforesaid billets were preheated to 600° C., they were heated to 1030° C. by induction heating and subjected to an extrusion manufacturing process, and thereafter were left standing-to-cool at a cooling rate of less than 5.0° C./second, and hot extruded shapes were further diffusion-annealed.

On the other hand, in the comparative examples (test No. 7 to 9) in Example 3 (Table 4), after the aforesaid billets were preheated to 600° C., they were heated to 1050° C. by induction heating and subjected to an extrusion work, and thereafter were forcibly cooled at a cooling rate of over 5.0° C./second, and hot extruded shapes were further diffusion-annealed. In the comparative examples (test No. 10 to 12) in Example 3 (Table 4), after the aforesaid billets were preheated to 600° C., they were heated to 1050° C. by induction heating and subjected to an extrusion work, and thereafter were cooled at a cooling rate of less than 0.5° C./second, and hot extruded shapes were further diffusion-annealed.

TABLE 4

| | | | MANUFACTURING METHOD | | | | | | EXTRUDED SHAPE QUALITY |
|---|---|---|---|---|---|---|---|---|---|
| TEST CLASSIFICATION | | ALLOY | | PRE-HEATING TEMPERATURE/° C. | INDUCTION HEATING TEMPERATURE/° C. | COOLING RATE/° C. · $s^{-1}$ | | ANNEALING TEMPERATURE/° C. | AVERAGE β GRAIN SIZE/ |
| No. | CATION | No. | PATTERN | | | A | B | | μm |
| 1 | INVENTION | 1 | a | 600 | 1030 | 4.2 | 3.8 | 700 | 136 |
| 2 | EXAMPLE | 2 | a | 600 | 1030 | 4.1 | 3.9 | 700 | 125 |
| 3 | | 3 | a | 600 | 1030 | 4.0 | 3.8 | 700 | 129 |
| 4 | | 1 | b | 600 | 1030 | 1.7 | 1.8 | 700 | 135 |
| 5 | | 2 | b | 600 | 1030 | 1.7 | 1.8 | 700 | 131 |

TABLE 4-continued

| | | | | | | | | | |
|---|---|---|---|---|---|---|---|---|---|
| 6 | | 3 | b | 600 | 1030 | 1.7 | 1.8 | 700 | 140 |
| 7 | COMPARATIVE | 1 | b | 600 | 1050 | 305 | 201 | 700 | 105 |
| 8 | EXAMPLE | 2 | b | 600 | 1050 | 306 | 158 | 700 | 112 |
| 9 | | 3 | b | 600 | 1050 | 521 | 215 | 700 | 121 |
| 10 | | 1 | b | 600 | 1050 | 0.05 | 0.05 | 700 | 158 |
| 11 | | 2 | b | 600 | 1050 | 0.06 | 0.05 | 700 | 160 |
| 12 | | 3 | b | 600 | 1050 | 0.06 | 0.06 | 700 | 172 |

| | EXTRUDED SHAPE QUALITY | | | | | | | |
|---|---|---|---|---|---|---|---|---|
| TEST No. | V CONCEN-TRATION RATIO | Fe CONCEN-TRATION IN β PHASE (mass %) | AVERAGE WIDTH OF GRAIN BOUNDARY α PHASE/ μm | 0.2% PROOF STRESS/ MPa | TENSILE STRENGTH/ MPa | ELONGA-TION (%) | MICRO STRUCTURE | WARP/ mm |
| 1 | 0.22 | 1.2 | 1.8 | 896 | 968 | 14.1 | ACICULAR | 8.4 |
| 2 | 0.21 | 1.3 | 1.5 | 880 | 950 | 14.3 | ACICULAR | 7.1 |
| 3 | 0.22 | 1.2 | 1.7 | 904 | 970 | 14.2 | ACICULAR | 6.5 |
| 4 | 0.22 | 1.2 | 2.8 | 895 | 961 | 14.2 | ACICULAR | 6.2 |
| 5 | 0.21 | 1.3 | 2.7 | 872 | 949 | 14.8 | ACICULAR | 7.2 |
| 6 | 0.21 | 1.4 | 2.8 | 912 | 966 | 14.3 | ACICULAR | 7.1 |
| 7 | 0.22 | 1.5 | 0.5 | 944 | 1027 | 13.8 | ACICULAR | 75 |
| 8 | 0.21 | 1.4 | 0.6 | 938 | 1021 | 13.2 | ACICULAR | 94 |
| 9 | 0.21 | 1.4 | 0.5 | 945 | 1031 | 12.6 | ACICULAR | 81 |
| 10 | 0.22 | 1.5 | 10.5 | 776 | 848 | 9.5 | ACICULAR | 4.2 |
| 11 | 0.21 | 1.4 | 11.2 | 760 | 851 | 8.9 | ACICULAR | 4.4 |
| 12 | 0.21 | 1.4 | 10.7 | 775 | 846 | 9.2 | ACICULAR | 5.1 |

The test No. 7 to 9 exhibited high 0.2% proof stress, but a warp of 50 mm or more occurred therein. This is because, though the forced cooling inhibited the growth of a grain boundary α phase, plastic deformation occurred due to large internal stress generated during the cooling.

In the test No. 10 to 12, since the width of a grain boundary α phase was over 10 μm due to the low cooling rate after the extrusion, the 0.2% proof stress was lower than 830 MPa and the elongation was also lower than 10%.

On the other hand, in the test No. 1 to 6 of the present invention, since the prior β grain size was controlled to 250 μm or less, the 0.2% proof stress was over 830 MPa even without performing the forced cooling. Further, warps of the extruded shapes were as small as 10 mm or less, which was on a practically satisfactory level.

INDUSTRIAL APPLICABILITY

According to the present invention, by controlling the metal microstructure of the extruded shape to the acicular microstructure in which the prior β grain size is 250 μm or less, it is possible to obtain an extruded shape having a practically satisfactory tensile property and as compared with a case where the forced cooling is performed, having a better shape. Therefore, a cost for a cooling device and shape correction can be reduced, which is especially industrially advantageous. Further, having a small residual stress and a small variation in the microstructure, the α+β titanium alloy extruded shape of the present invention is expected to bend only a little during a mechanical work and to be excellent in fatigue strength, and thus is useful in the application in airplanes and so on.

EXPLANATION OF CODES

1 container
2 stems
3 dummy block
4 die
5 billet
6 extruded shape
11 extrusion direction
10

What is claimed is:

1. An α+β titanium alloy extruded shape containing, in mass %, Al: 5.5 to 6.8%, V: 3.5 to 4.5%, and Fe: over 0 to 0.30%, the balance being Ti and impurities, the impurities amounting to a total of 0.4% or less and, in a microstructure observation position which does not include an exterior surface of the α+β titanium alloy extruded shape, the alloy consisting of an acicular microstructure in which an average prior β grain size is 250 μm or less, wherein the prior β grain is defined as a region surrounded by a grain boundary α phase, which is a grain boundary of a β grain present at a β transus temperature or higher, the microstructure observation position is a cross section of 3000×6000 μm parallel to an extrusion direction and perpendicular to a surface observed using an optical microscope, and a 0.2% proof stress is 830 MPa or more, an elongation is 10% or more, a tensile strength is 900 MPa or more in a tensile test using a tensile test specimen in which a parallel part of the tensile test specimen does not include the exterior surface of the α+β titanium alloy extruded shape.

2. The α+β titanium alloy extruded shape according to claim 1, wherein the average prior β grain size is 180 μm or less.

3. The α+β titanium alloy extruded shape according to claim 1, wherein, in a colony of the acicular microstructure, an average ratio of a concentration of V contained in a side plate α phase to a concentration of V contained in a side plate β phase is 0.24 or less, and an average concentration of Fe contained in the side plate β phase is 1.1% or more.

4. The α+β titanium alloy extruded shape according to claim 1, wherein a width of a grain boundary α phase is 5 μm or less.

* * * * *